US005670996A

United States Patent [19]

Mitani

[11] Patent Number: 5,670,996

[45] Date of Patent: Sep. 23, 1997

[54] THERMAL INK JET RECORDING DEVICE AND METHOD OF CLEANING A RECORDING HEAD

[75] Inventor: Masao Mitani, Hitachinaka, Japan

[73] Assignee: Hitachi Koki Co., Ltd., Tokyo, Japan

[21] Appl. No.: 414,490

[22] Filed: Mar. 31, 1995

[30] Foreign Application Priority Data

Apr. 1, 1994 [JP] Japan ..... 6-065005

[51] Int. Cl.[6] ..... B41J 2/165

[52] U.S. Cl. ..... 347/29; 347/30; 347/33; 347/35; 347/44

[58] Field of Search ..... 347/29, 33, 35, 347/44, 30

[56] References Cited

U.S. PATENT DOCUMENTS 4,947,191 8/1990 Nozawa et al. ..... 347/30
5,040,000 8/1991 Yokoi ..... 347/30
5,298,923 3/1994 Tokunaga et al. ..... 347/30 X
5,504,508 4/1996 Hashimoto ..... 347/24

FOREIGN PATENT DOCUMENTS 6-87219 11/1991 Japan ..... 347/33
3-253347 3/1994 Japan ..... 347/29

*Primary Examiner*—John E. Barlow, Jr.
*Attorney, Agent, or Firm*—Whitham, Curtis, Whitham & McGinn

[57] ABSTRACT

In an ink jet recording device of the type wherein ink droplets are ejected from orifices using thermal energy and the heater for supplying the thermal energy is oriented in a direction substantially perpendicular to the orifice surface, a cleaning unit is provided for cleaning the head of the device. The cleaning unit includes an integral wiper and ink pool. In cleaning the head, ink that gathers on the wiper will drip downward by its own weight, resulting in very little spread toward adjacent orifice, thereby minimizing the degree at which different color inks mix on the surface of the head.

19 Claims, 5 Drawing Sheets

THERMAL INK JET RECORDING DEVICE AND METHOD OF CLEANING A RECORDING HEAD

BACKGROUND OF THE INVENTION

1. Field of the Invention

The present invention relates to a thermal ink jet recording device which uses thermal energy to eject ink droplets. The invention relates further to a method of cleaning the recording head of the thermal ink jet recording device.

2. Description of the Related Art

Recently, extensive use of office automation equipment has brought development of many compact and inexpensive recording devices. Thermal jet recording devices are being developed at a particularly rapid rate. Their development can be expected to continue. The greatest problem to be overcome is to increase the relatively slow printing speed of thermal jet recording devices. One solution to increase the printing speed is to increase the number of dots ejected from the head. To this effect, production of a large-scale and high-density print head becomes necessary.

The importance of head cleaning for insuring good print quality is well known. However, cleaning sufficiently to maintain the reliability of a head becomes increasingly difficult with increases in the number of dots ejected from the head and is even more difficult with heads for printing in color. The present invention relates to head cleaning and to a method of head maintenance.

Next, an explanation of the prior art will be provided. To prevent ink staying in nozzles open to the external atmosphere from drying or becoming overly viscous, the orifice surface (that is, where the orifices of nozzles are aligned on the print head) must be capped while recording devices are not recording. However, the viscosity of ink in nozzles will increase near the orifices when printing is not performed for long periods of time even when the orifice surface is capped. Therefore, it is necessary to discharge the overly viscous ink before recording operations are recommenced. During recording, a wiper member cleans ink or foreign matter off the orifice surface of the head. However, the wiper member may push the viscous ink or foreign matter into the orifice openings during cleaning.

There has been known a method of sucking ink from ink nozzles by decreasing pressure within the nozzle while the cap is still covering the orifice surface. There has also been known a method of wiping foreign matter and the like off the orifice surface while increasing pressure in the nozzles to eject ink from the nozzles. Refer to Japanese Laid-Open Patent Publication Nos. SHO-57-9547 and SHO-57-96866. However, these methods waste a great deal of ink because the same pressure is applied to ink in all of the nozzles. Also, nozzles are not always effectively cleaned with these methods.

Japanese Laid-Open Patent Publication No. HEI-02-95862 describes a similar method wherein the orifice surface is wiped while ink is ejected. However, when the wiper covers the orifice of an ejecting nozzle, a large backflow is generated in the ink of a nozzle whose orifice is covered. Therefore, this method is not always effective. Japanese Laid-Open Patent Publication No. SHO-61-230950 describes the simplest but most effective method wherein dummy ejections are performed after wiping. Ejecting ink for other than printing purposes is referred to as dummy ejections. Japanese Laid-Open Patent Publication No. SHO-59-14963 describes cleaning a dirty wiper in order to prevent the orifice surface from becoming dirty by wiping it with the uncleaned wiper. All of these methods pertain to cleaning methods applied to monochromic heads that are scanned across the full width of the recording sheet during recording, wherein during cleaning, the heads are moved beyond the edge of the recording sheet to be wiped with wipers projected toward the heads.

The same cleaning methods are used for color heads. Japanese Laid-Open Patent Publication Nos. SHO-64-69352 and HEI-03-130160 describe a method of sequentially wiping each different color head of a multicolor head. In the same way as for cleaning a monochrome head, after wiping, a dummy ejection discharges the different colors mixed into the orifices by wiping, thus automatically solving the problem of mixing of colors. However, because the heads of different colors are wiped with a single wiper one after another, the amount of ink and number of colors of ink clinging to the wiper increases with each different color head. When the head is later cleaned through dummy ejections, mixing of ink in the head becomes severe so that a great number of dummy ejections become necessary to discharge the mixed ink. There has been proposed a method of cleaning ink in order of brightness so that even if different color inks mix, the mixing will not be very noticeable.

It has been difficult to produce a thermal ink jet recording head in a large scale integrated form. Normally 64 droplet generators are formed in a single substrate at a density of 300 to 400 dots per inch (dpi). The number of droplet generators formed to the same substrate is at maximum 256. To produce a full-color head, conventionally four heads, generally designated in FIG. 1 by reference numeral 42, are mounted onto a single reciprocally moving shuttle 43.

The present inventor proposed a 360 dpi full-color head with 6,048 nozzles (1,512 nozzles×4 rows) formed on a 8 mm by 105 mm substrate. A full-color print head large enough to print an A4 size sheet in a single scan can be produced by linearly mounting two such heads on the same frame. However, insuring reliability of this large-scale integrated head is ten times more difficult than with the conventional head shown in FIG. 1. That is, while the recording device is inoperative, drying of the ink close to orifices in nozzles must not occur in such a short period of time as in the prior art device. The performance of the head must be increased to produce high pressure which allows the highly viscous ink to be discharged and bubbles to be expelled. The amount of ink mixing must be minimized and then dummy ejections performed to prevent the mixture of the color ink from reaching heaters of individual droplet generators.

SUMMARY OF THE INVENTION

It is an object of the present invention to provide an ink jet recording device that inexpensively fulfills these needs and that insures high print reliability.

It is another object of the present invention to provide a method of cleaning the ink jet recording device capable of minimizing mixing of ink colors to a possible minimum when an orifice surface is cleaned.

To achieve the above and other objects, an ink jet recording device of the present invention includes a thermal ink jet recording head formed with at least one row of nozzles. The nozzles are in fluid communication with atmosphere by orifices from which ink droplets are ejected. The thermal ink jet recording head has an orifice surface formed with the orifices which face downward at least during cleaning. A cleaning unit is further provided which includes an integral wiper and ink pool. The wiper wipes the orifice surface of the thermal ink jet recording head. The ink pool receives ink dripping from the wiper when the wiper wipes the orifice surface.

Moving means is provided for moving the cleaning unit in a direction substantially parallel to the direction in which the nozzles are aligned. Also provided is an ejection control unit which causes an ink droplet from each nozzle to be ejected toward the ink pool directly after wiping.

The thermal ink jet recording head includes heaters provided to respective ones of the nozzles. The nozzles eject ink from the respective orifices in a direction substantially perpendicular to the heating surface of each heater.

In further accordance with the present invention, nozzle unclogging means is provided for performing dummy ejections while sucking an area of the orifice surface covering a predetermined number of nozzles, and setting means is also provided for transporting the nozzle unclogging means to an instructed position of clogged nozzles.

Preferably, the wiper is made from either silicon resin or polytetrafluoroethylene.

In another aspect of the present invention, there is provided an ink jet recording device including a plurality of rows of nozzles aligned substantially parallel, wherein each nozzle is in fluid communication with atmosphere by an orifice and orifices are aligned in substantially parallel rows on an orifice surface. A cap is provided for the nozzles. The cap is formed with substantially parallel grooves for separately covering the orifices on the orifice surface. Preferably, the cap is formed from silicon rubber into a wave shape separately sealing each row of orifices.

In accordance with a further aspect of the invention, there is provided a method of cleaning an ink jet recording device of the type described above, wherein a wiper of a cleaning unit is brought into abutment against the orifice surface so that the wiper deforms from a natural shape, the wiper wipes across the orifice surface, ink clinging to the orifice surface is dripped down from the wiper, and the dripping ink is caught in an ink pool of the cleaning unit. The ink pool is integrally formed on either side of the wiper.

In the method as described above, the wiper is scanned beyond an edge of the head during cleaning so that the wiper resiliently snaps back into the natural shape. Directly after wiping, an ink droplet is ejected from each nozzle of the orifice surface toward the ink pool.

When the cleaning unit is applied for cleaning a full-color recording head, a single wiper wipes following the direction in which each orifice row for each color extends. Therefore, ink that gathers on the wiper will drip downward by its own weight. This method results in very little spread in the horizontal direction, thereby minimizing the degree at which different color inks mix on the surface of the head. Compared to the conventional thermal jet recording device shown in FIG. 1, where different color inks are completely mixed during wiping, the present invention largely prevents ink of one color from entering nozzles for another color. The wiper is made from a water repellent material so that the ink quickly drips off the sides of the wiper. The ink can be removed from the orifice surface twice as effectively if the orifice surface is also made water repellent. To insure that wiping operations go smoothly, the orifice surface must be facing downward at least during cleaning. Also the cleaning unit must be scanned over the orifice surface following the direction in which orifices of each color row are aligned.

The ink dripping from the sides of the wiper during wiping is accumulated in one ink pool provided integrally to the wiper at one side of the wiper. The other ink pool is for catching the one to several ink droplets dummy ejected from each nozzle directly after wiping. As mentioned previously, wiping according to the present invention causes very little mixing of different colors of ink. Any ink of one color that happens to mix with ink in a nozzle of a different color is ejected from the nozzle when a single dummy ejection is performed at each nozzle. However, sometimes several dummy ejections may be required to overcome severe obstruction of ink flow by foreign matter. The cleaning unit is symmetrical at its left and right sides (in regards to the scanning direction). Scanning while maintaining uniform positioning at the left and right side of the cleaning unit will effectively increase the life of the wiper and will reduce the effects to the nozzle tip portion of the head. In an illusory example, 20 or more dummy ejections are possible when the ink pool is 5 mm long in the scanning direction, the cleaning unit is scanned at 210 mm every two seconds, the open space in the ink pool where dummy ejected ink droplets can be caught is 3 mm (that is, the area that remains exposed regardless of the bending wiper), and dummy ejections are ejected at a slow frequency of 1 KHZ. Moreover, dummy ejections with a large tolerance are possible even when a compact cleaning unit is used.

The present invention is more efficient than a cleaning unit which requires a separate cleaner for cleaning the wiper free of ink accumulated on the wiper during cleaning. According to the present invention, the wiper is scanned past the edge of the head. When the wiper passes the edge of the head, the wiper snaps back into its natural shape so as to shake ink off its surface. The effectiveness of this shaking off cleaning is related to the water repellency of the wiper material. Therefore, it is preferable that the wiper be formed from silicon rubber or PTFE (polytetrafluoroethylene) resin. According to the present invention, it is preferable to store the cleaning unit in a sealed space to prevent any residual ink on the wiper from drying. Ink that drips off the wiper and that is dummy ejected from the head will accumulate in the ink pools to a level sufficient to provide a high ink vapor pressure in the sealed space where the cleaning unit is stored, thus preventing ink on the surface of the wiper from completely drying. When the wiper is next used, only a minimum amount of ink will be clinging to its surface. Moreover, the clinging ink will still be wet. Therefore, highly reliable cleaning is possible compared to conventional technology wherein a dirty wiper covered with dry or highly viscous ink is used. Additionally, it is beneficial if the configuration of components causes the wiping surface of the wiper to be automatically wiped clean by passing across the edge of the head directly before cleaning operations begin.

Ink in the orifices can be completely prevented from drying by completely sealing each orifice on the orifice surface of the head using, for example, a silicon rubber cap. The amount of ink clinging to the surface of the silicon rubber after cleaning (after shaking off) is minimized by the water repellency of the silicon rubber. Because the wiper is stored in a sealed space after being cleaned, the surface of the wiper will not be dirtied even during repeated capping operations.

When ink ejection becomes unstable or impossible because of foreign matter or bubbles mixed in the ink channel, conventionally nozzles are cleaned by sealing the surface of the head with a cap and forming a vacuum suction in the cap. However, when this method is applied to a large-scale integrated head having a great many nozzles, the suction formed in the large-sized cap required for sealing the entire orifice surface of the head draws too much ink from normally operating (non-clogged) nozzles. The ink from normally operating (non-clogged) nozzles is wasted. Also, it is difficult to generate a pressure difference high enough to effectively unclog nozzles. Although the most efficient method of unclogging nozzles is to dummy eject only clogged nozzles while applying a vacuum only to the clogged nozzles, this method requires an expensive means for aligning the sucking means with the clogged nozzles. In the present invention, the general position of a clogged nozzle is indicated manually, whereupon ten nozzles in the general area of the clogged nozzle are all vacuum suctioned while being dummy ejected. Of course in the case of full-color heads, the ink color of the clogged nozzle can be easily recognized, so only nozzles for ejecting that color ink should be dummy ejected.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

A recording device and method according to a preferred embodiment of the present invention will be described while referring to the accompanying drawings.

Figure 1:
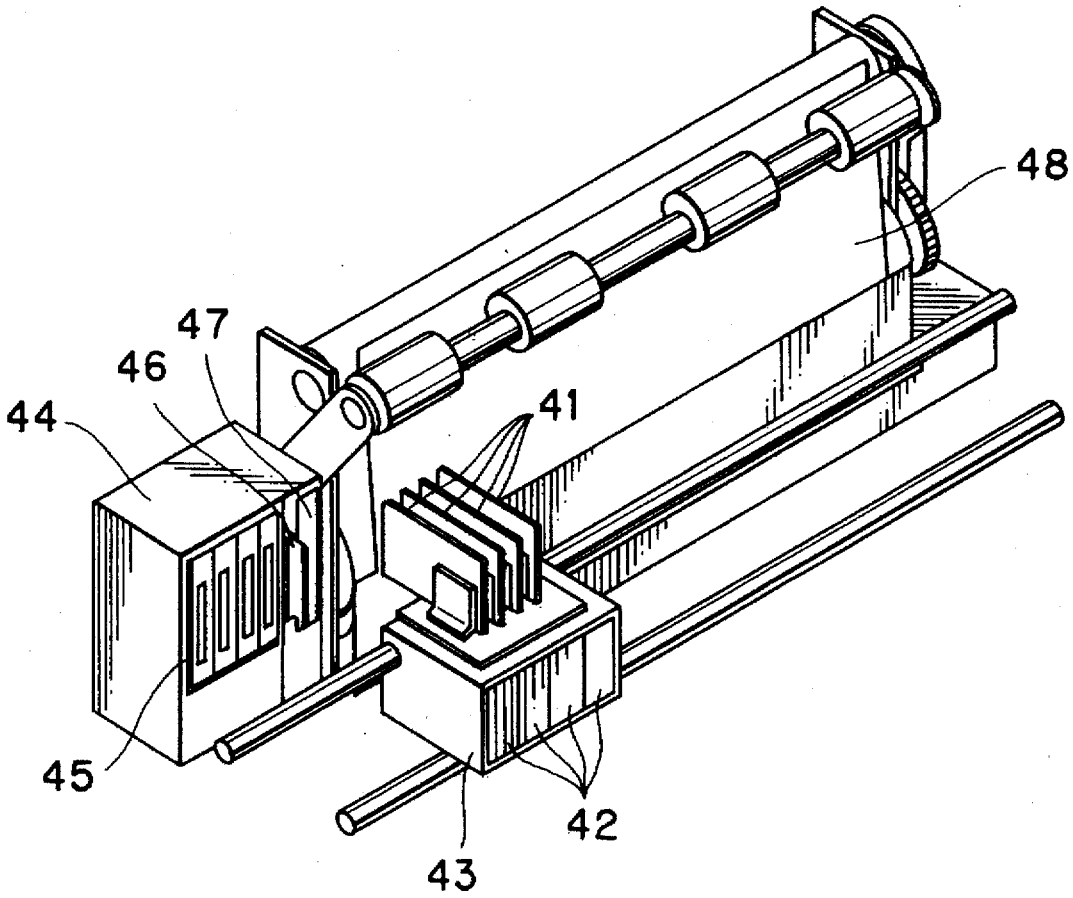
FIG. 1 is a perspective view showing a conventional printer.
Figure 2:
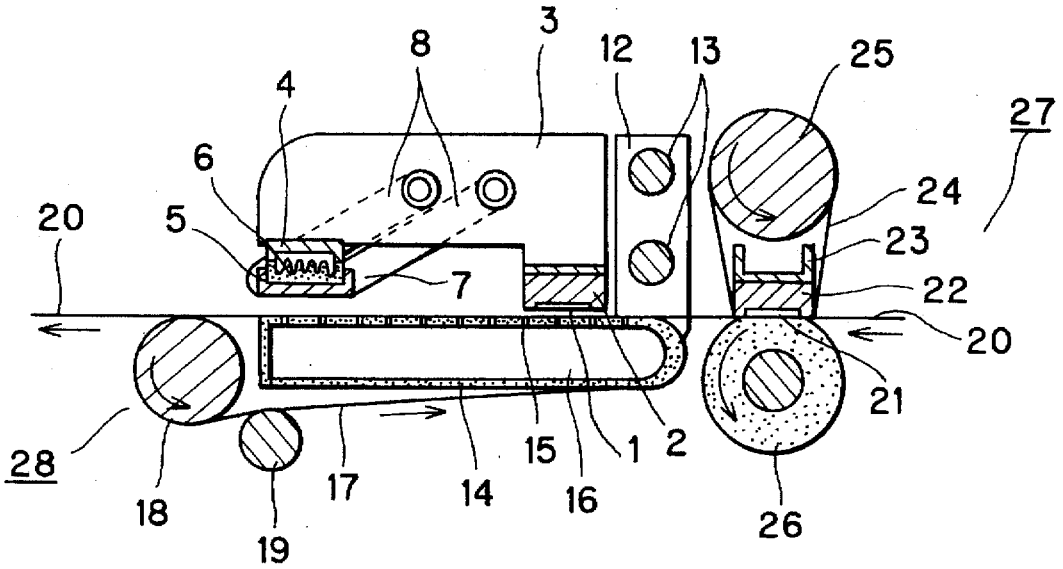
FIG. 2 is a cross-sectional view showing a printer according to the present invention.

FIG. 2 is a cross-sectional diagram showing an A4 full-color high-speed ink jet printer according to the present invention. FIG. 2 shows the condition of the ink jet printer during printing. A recording sheet 20 is heated by a belt-type preheater 27. The preheater 27 has good thermal efficiency. A suction transport unit 28 transports the heated recording sheet 20 at a fixed speed under a full-color line head 1. An image is printed on the recording sheet 20 by ejecting four different colors of ink from the four rows of nozzles aligned on the full-color line head 1. The ink quickly dries on the heated recording sheet 20. The recorded sheet 20 can be handled even when printed at a print speed 10 to 20 times faster than normal for full-color ink jet printers. This greatly improves print quality by reducing smudges often seen in sheets printed by ink jet printers.

Figure 3:
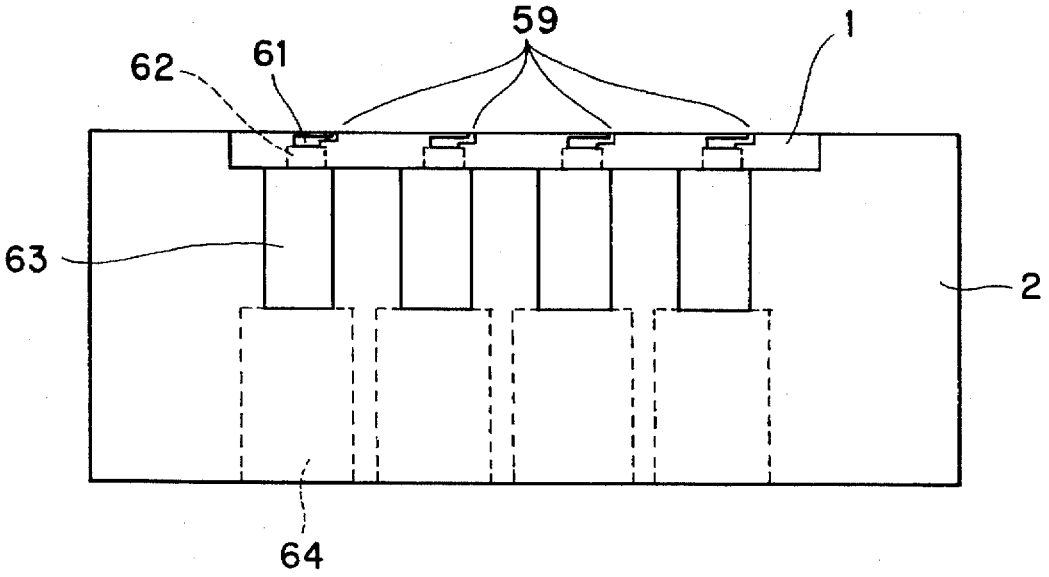
FIG. 3 is an enlarged cross-sectional view showing a structure including a head and a head mounting frame of the printer shown in FIG. 2.

FIG. 3 is an enlarged cross-sectional view of the full-color line head 1 and the head mounting frame 2 on which the full-color line head 1 is mounted. FIG. 4(B) is a cross-sectional view showing details of area near a single ink generator. Four colors of ink supplied from an external source (not shown in the drawings) are introduced into the ink supply ports 64 of the frame 2, pass through the respective ink channels 63 provided in the frame 2, connection holes 62 opened intermittently in the silicon substrate, and substrate common ink channels 61 in the silicon substrate, and is ejected from the nozzles 59. A total of 1,512 nozzles 59 are aligned for each color at a pitch of, for example, 70 μm (360 dpi) in the direction perpendicular to the surface of the sheet on which FIG. 3 is printed. This amounts to a total of 6,048 nozzles provided in the single substrate of the full-color line head 1. The symmetrical full-color line head 1 is produced from two substrates aligned in a straight line on the same frame 2. The abutting ends of the two substrates are connected at the central portion of the frame 2 by die bonding. FIG. 4 (B) shows details of the area around an individual nozzle where the two different substrates are connected.

Figure 4A:
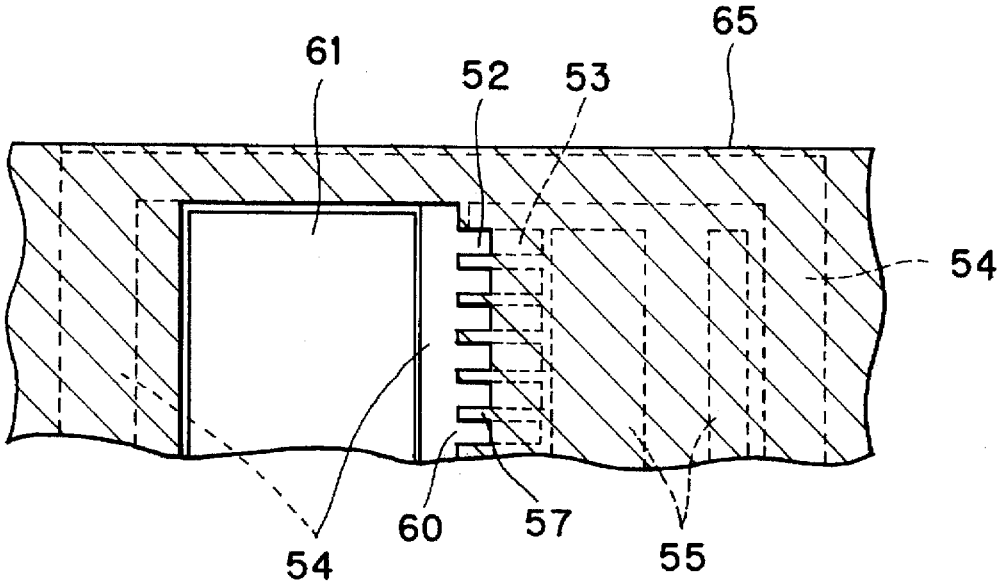
FIG. 4(A) is a plan view partially showing a print head as viewed in a direction B–B' shown in FIG. 4(B)
Figure 4B:
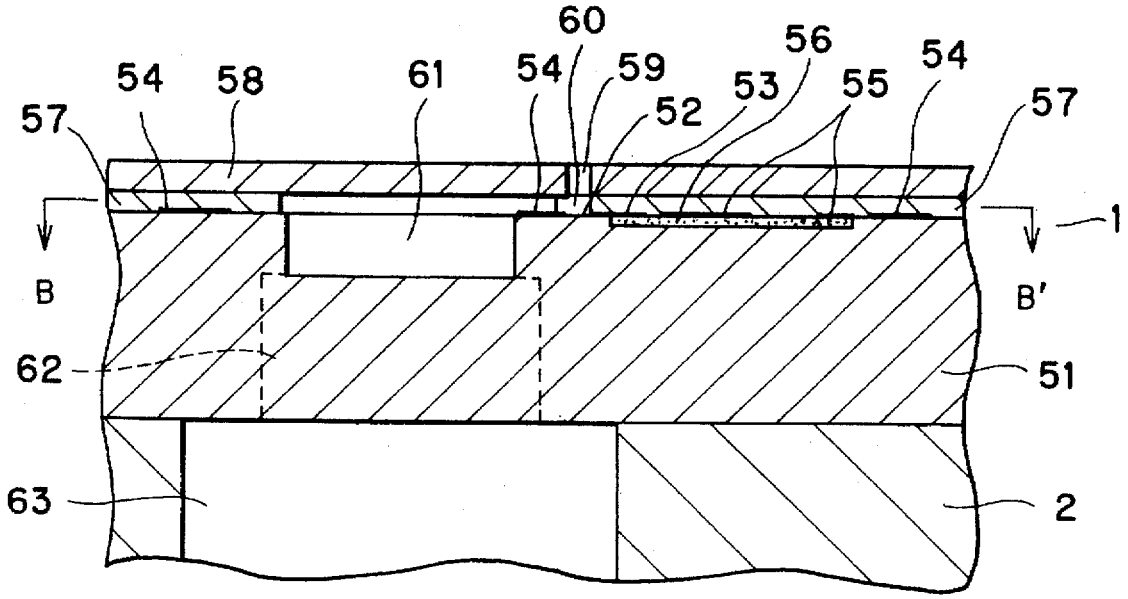
FIG. 4(B) is a cross-sectional view showing the print head.

FIGS. 4(A) and 4(B) also show a protection-layerless heater 52 made from a 42 μm by 42 μm Cr—Si—SiO alloy thin-film thermal resistor. The heater 52 is accommodated in a 50 μm by 50 μm ink ejection chamber. Partition walls between ink ejection chambers are formed, using photosensitive film resist techniques, to a height of 25 μm. Nozzles 59 are formed with a diameter of 40 μm and incline about 6° toward the abutting surface 65 of the two substrates so that the printed dots in the substrate connected area becomes uniform. The head 1 is mounted to a carriage so as to confront a recording sheet separated by a distance of 1.2 mm.

The individual thin-film conductor lines 53, the common thin-film conductor line 54, and the conductor lines 55 for driving the driver IC device 56 are all formed from a 2 μm thick nickel (Ni) thin film. None are covered with protection layers. These thermal resistor and conductor materials are all sufficiently reliable when operated in water-based ink even without protective coverings. In order to reduce the resistance value of the common thin-film conductor line 54, the periphery of the driver IC device 56 and the substrate common ink channels 61 are used as a wiring region. Because of this, resistance of wiring can be reduced to 20 ohms or less in regards to the 400 ohm resistance of the heater 52. Even if there is variation in resistance between individual heaters, it is possible to suppress the amount of heat generated by the heater 52 to within +/−10% when heated by the same voltage.

Figure 5:
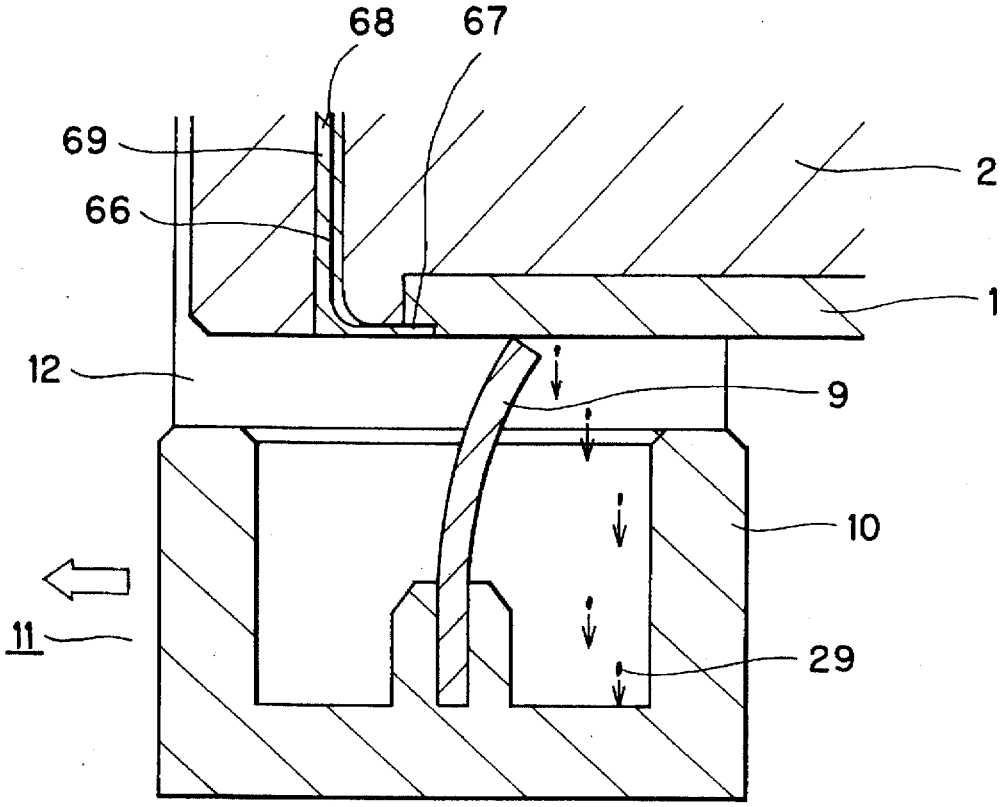
FIG. 5 is a cross-sectional view cut along a line A–A' shown in FIG. 6.

As shown in FIG. 5, an external circuit is connected to either end of the line head 1 by a tape carrier 66 formed by bonding together 24 wires (i.e., four rows of six wires for a total of 24 wires). The driver IC device 56, which is constructed from a driver circuit and a shift register, is driven by a drive signal inputted over the tape carrier 66. The tape carrier 66 passes through the frame 2 and extends from the rear of the frame 2. The tape carrier bonding portion 67 and the tape carrier pull-out channel 68 are buried in resin on the silicon substrate 51 and polished down so that the surface between the frame 2 and head 1 is planar.

The following is an explanation of a cleaning method, method of overcoming clogging of nozzles, method of head maintenance, method of cleaning and maintaining the wiper, and method of maintaining a cap of an A4 full-color line head configured as described above used as a printer for full-color printing.

Figure 6:
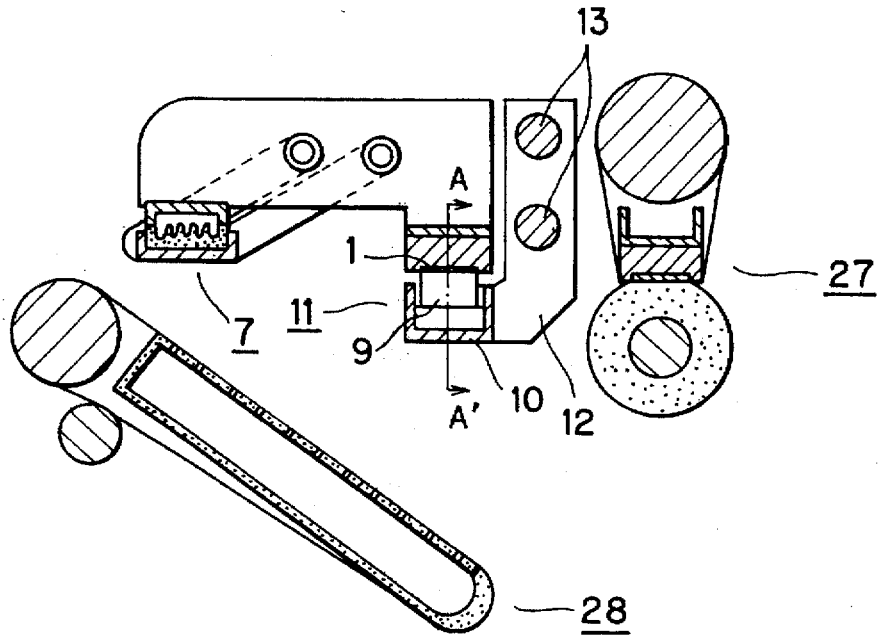
FIG. 6 is a cross-sectional view showing a cleaning condition of the printer according to the present invention.
Figure 7:
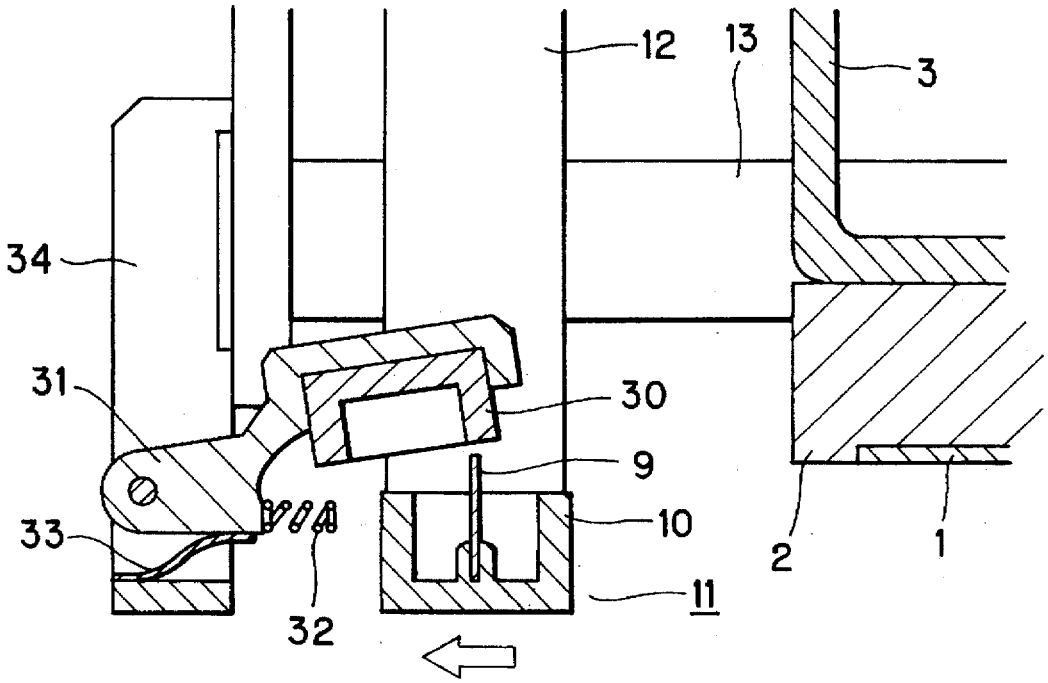
FIG. 7 is a cross-sectional view showing a capping operation of a cleaning unit.

A concrete description of a method for cleaning the ejection surface of the head will be provided while referring to FIG. 6. During cleaning, the suction transport unit 28 is pulled away from the head surface. The cleaning unit 11 is moved from a retracted position which may be the extreme left or right end of the full-color line head 1 to the opposite end. As shown in FIG. 7, the cleaning unit 11 is sealed by a cap 30. Ink clinging to the wiper 9 will be prevented from drying when the cleaning unit 11 is in the sealed condition because the sealing of the cap 30 maintains a saturated vapor condition within the cap 30. The cap 30 opens simultaneously with start of movement of the cleaning unit 11 from the retracted position. The head-wiping surface of the wiper 9 abuts the edge of the frame 2 and wiping of the head ejection surface begins. In this embodiment, storage positions for the cleaning unit 11 are provided at both edges of the line head 1. Although also providing a capping mechanism to both sides of the line head 1 will increase the life of the wiper, only one capping mechanism need be provided at one side.

FIG. 5 shows the wiper 9 wiping the ejection surface of the head. When the four different colors of ink clinging to the ejection surface of the head 1 are wiped clean by the wiper 9, the four different types of ink gather on the wiping surface of the wiper 9, run along the length of the wiper 9, and accumulate in the ink pool 10. Although the different rows of ink ejection orifices are separated from adjacent rows by about 2 mm, some mixing of colors will occur when the different color inks gather on the wiper 9 during wiping. It is impossible to avoid some mixing of different color inks near the ejection orifices. However, if the mixed ink can be dummy ejected before it spreads too much, that is, while it is still near the ink channels 60, then the problem of different color inks mixing can be completely solved. The ink portion confronting the heater 52 can be completely ejected by a single dummy ejection. According to evaluation tests, 0.1 second or more was required after wiping with the wiping method according to the present invention for ink of one individual ink channel to spread near another. So much time is required because mixing of different colored inks is greatly reduced by the wiping method according to the present invention. Typically wiping is performed by moving the wiper 9 at a speed of 210 mm every two to three seconds. Therefore, 0.01 to 0.02 seconds pass between the time from mixing of colors starts by wiping until the dummy ejection. Therefore, the problem of mixing of colors can be completely solved by performing a dummy ejection directly after wiping. It is easy to control the position of the cleaning unit 11 during each speed to within +/−0.5 mm difference. It is therefore necessary to delay the dummy ejection by 0.01 second.

As shown in FIG. 5, the cleaning unit 11 is scanned beyond the edges of the mounting frame 2 of the full-color line head 1. Therefore, wiper 9, which is bent when in contact with the ejection surface of line head 1, will snap back into its natural shape so that almost all of the ink clinging to the wiping edge of the wiper 9 is shaken off. Because the wiper 9 is made from a water repellent material such as PTFE (polytetrafluoroethylene) or silicon rubber, clinging ink can be effectively removed from the wiper 9. Making the outer surface of the frame 2 from PTFE or silicon rubber will reduce the amount of ink that clings to the surface of the frame 2, thereby reducing the amount of ink that accumulates on the wiper 9 surface during wiping.

After cleaning operations are completed, the cleaning unit 11 is sealed by the cap 30 and stored at the predetermined storage position at the edge of the head as shown in FIG. 7. Ink from new dummy ejections and the like was freshly collected in the ink pool 10 directly prior to this. The vapor pressure of the fresh ink prevents the slight amount of ink remaining on the surface of the wiper 9 from drying.

Figure 8:
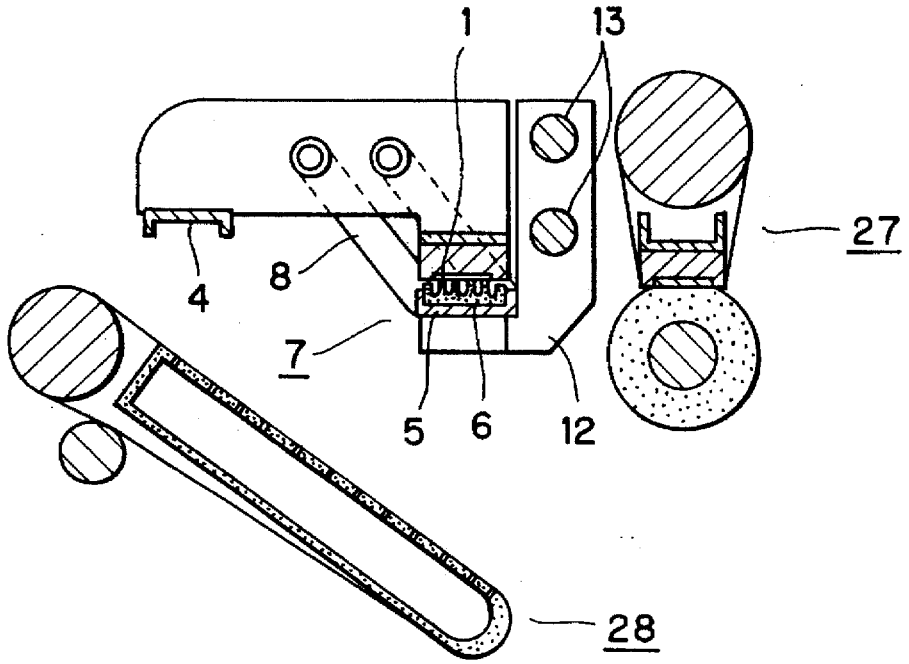
FIG. 8 is a cross-sectional view showing that the capping operation of the cleaning unit is complete in the printer shown in FIG. 2.

As can be seen in FIG. 8, after the cleaning unit 11 is stored, the cap 6 is placed over the head 1 to seal it. The cap 6 is made from silicon rubber into a corrugated or furrowed shape (as seen in cross section) with grooves for individually sealing nozzle rows of the head 1. Therefore, the cap 6 seals nozzles separately by color so that the ink will not dry because only a small surface of ink in the nozzle (i.e., the meniscus of ink in nozzles) is exposed to air. The cap is made from a water repellent material so that only a minimal amount of ink leaks from the cap surface when the cap is opened. The cap 30 is stored in a cover 4 (as shown in FIG. 2) after its surface is wiped. Therefore, the cap surface will not be soiled by dust and the like. Because the silicon rubber cap 6 has a corrugated shape, different color inks will not mix while the cap 6 covers the head 1.

Dirt and bubbles that mix with the ink during exchange of ink can obstruct the flow of ink in the ink channels and adversely effect firing of nozzles. Poor ejection from nozzles can be corrected in heads with 10 to 256 nozzles either by slowly discharging obstruction by pressurizing the ink or by sucking the obstructions out by reducing pressure in the cap. However, a large-scale, high-density head of the present embodiment has well over ten times as many nozzles per head (up to 6,048 nozzles). Therefore, the ratio of defective nozzles, to be corrected in each correction operation, to correctly-operating nozzles (i.e., the number of defective nozzles/number of correctly-operating nozzles) is one tenth of the same ratio in smaller heads. Therefore, obstructions in the ink of such large heads can not be very effectively performed using pressurization or suction. On the other hand, performing dummy ejections while either pressurizing or sucking greatly increases the flow speed of ink in ink channels and is therefore very effective in removing debris and unclogging nozzles. With this method, nozzles can be inexpensively and effectively unclogged. Tests showed the most effective method to be manually inputting the approximate position (in an area several millimeters wide) of a defectively ejecting nozzle and then sucking while dummy ejecting the surrounding 10 or so ink nozzles. In this way, the amount of ink ejected from nozzles other than the defectively ejecting nozzle can be minimized. The nozzle for sucking the clogged and nearby nozzles need only be large enough to suction a surface area equivalent to 10 nozzles. Also, the positioning mechanism can be made relatively simply.

The present invention can be applied equally effectively to monochromatic heads and full-color heads. The same head storage method described above can also be applied to half-line heads or quarter-line heads that are scanned across the width of the recording sheet. The predetermined head storage position can be established at one side of the recording sheet.

According to the present invention, the amount of mixing between different colored inks when the ejection surface of the head is wiped in the direction in which the nozzle are aligned is greatly reduced. Moreover, mixing can be completely prevented by performing a single dummy ejection from each nozzle directly after the nozzle is wiped. A compact, highly efficient head cleaning mechanism can be formed by integrating the wiper and the ink pools, which are for receiving ink from the dummy ejections and ink collected on the wiper during wiping, into a compact cleaning unit. Also, cleaning can be efficiently performed by wiping the head with the wiper. Ink in nozzles can be completely prevented from drying by directly sealing nozzles on the ink ejection surface (orifice surface) by color. The present invention also provides an improved method of cleaning the ejecting surface of the head that increases the reliability of the thermal ink jet printer. In this method, a defectively ejecting nozzle is unclogged by simultaneously sucking and performing dummy ejections from 10 nozzles around where the defectively ejecting nozzle is assumed to be.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. An ink jet recording device comprising:

a thermal ink jet recording head formed with at least two rows of nozzles aligned in a direction, the nozzles being in fluid communication with atmosphere by orifices, said thermal ink jet recording head having an orifice surface formed with at least two rows of orifices aligned in closely spaced relation, from which ink droplets of at least two colors are ejected and which face downwardly at least during cleaning;

a cleaning unit including an integral wiper and ink pool, the wiper for wiping the orifice surface of said thermal ink jet recording head, and the ink pool for receiving ink dripping from the wiper when the wiper wipes the orifice surface; and an ejection control unit for causing an ink droplet from each nozzle to be ejected toward the ink pool directly after wiping.

2. An ink jet recording device as claimed in claim 1, further comprising moving means for moving said cleaning unit in a direction substantially parallel to the direction in which the at least two rows of nozzles are aligned.

3. An ink jet recording device according to claim 1, wherein said wiper is formed of resilient, water-repellent material such that after wiping said orifice surface of said thermal ink jet recording head, sad wiper snaps back into an undeformed shape prior to cleaning, thereby shaking off ink from a surface of said wiper, said ink jet recording device further comprising means for performing dummy ejections from said nozzles while simultaneously sectioning an area of the orifice surface covering a predetermined number of nozzles.

4. An ink jet recording device as claimed in claim 1, wherein said thermal ink jet recording head includes heaters provided to respective ones of the at least two rows of nozzles, each heater having a heating surface, and the at least two rows of nozzles ejecting ink from the respective orifices in a direction substantially perpendicular to the heating surface.

5. An ink jet recording device as claimed in claim 1, further comprising:

nozzle unclogging means for performing dummy ejections while sucking an area of the orifice surface covering a predetermined number of nozzles; and setting means for transporting said nozzle unclogging means to an instructed position of clogged nozzles.

6. An ink jet recording device as claimed in claim 1, wherein the wiper is made from silicon resin.

7. An ink jet recording device as claimed in claim 1, wherein the wiper is made from polytetrafluoroethylene.

8. An ink jet recording device according to claim 1, wherein said wiper is formed of resilient material such that after wiping said orifice surface of said thermal ink jet recording head, said wiper snaps back into its shape prior to cleaning and ink is shaken off a surface of said wiper, and wherein said orifices face in a direction parallel to a direction of a gravitational force.

9. An ink jet recording device according to claim 1, wherein said wiper is formed of water-repellent material.

10. An ink jet recording device according to claim 1, further comprising:

means for performing dummy ejections from said nozzles after said wiping of the orifice surface by said wiper, said dummy ejections being performed substantially less than 0.01 seconds from wiping by said wiper.

11. An ink jet recording device according to claim 1, further comprising:

means for performing dummy ejections from said nozzles after said wiping of the orifice surface by said wiper, said dummy ejections being performed within substantially 0.01 and 0.02 seconds from wiping by said wiper.

12. An ink jet recording device according to claim 1, wherein said ink pool is integrally formed on first and second sides of said wiper, and said orifices face in a direction parallel to a direction of a gravitational force, and wherein ink gathering on said wiper drips directly downward by gravitational force into said ink pool, so as to minimize ink spreading into adjacent orifices.

13. An ink jet recording device comprising:

a plurality of rows of nozzles aligned substantially parallel with each other, each nozzle being in fluid communication with atmosphere by an orifice, orifices being aligned in substantially parallel rows on an orifice surface; and a cap formed with substantially parallel grooves for separately covering each of the substantially parallel rows of orifices on the orifice surface.

14. An ink jet recording device as claimed in claim 13, wherein the cap is formed from silicon rubber into a wave shape separately sealing each row of orifices.

15. A method of cleaning an ink jet recording device having an orifice surface provided with at least two rows of orifices from which ink droplets of at least two colors are ejected, said at least two rows of orifices of the orifice surface being aligned in closely spaced relation and facing downwardly at least during cleaning, the method comprising steps of:

abutting a wiper of a cleaning unit against the orifice surface so that the wiper deforms from a natural shape;

wiping the orifice surface by moving the wiper thereacross, ink clinging to the orifice surface being squeegeed off the orifice surface so as to drip down the wiper;

catching the dripping ink in an ink pool of the cleaning unit, the ink pool being integrally formed on either side of the wiper; and causing an ink droplet from each orifice to be ejected toward the ink pool directly after wiping.

16. A method as claimed in claim 15, further comprising the step of ejecting an ink droplet from each nozzle of the orifice surface toward the ink pool directly after wiping.

17. A method as claimed in claim 15, further comprising the step of scanning the wiper beyond an edge of the head during cleaning so that the wiper resiliently snaps back into the natural shape.

18. A method as claimed in claim 15, wherein the wiper is made from silicon resin.

19. A method as claimed in claim 15, wherein the wiper is made from polytetrafluoroethylene.

* * * * *